US008710727B2

(12) United States Patent
Liu et al.

(10) Patent No.: US 8,710,727 B2
(45) Date of Patent: Apr. 29, 2014

(54) FIELD EMISSION CATHODE STRUCTURE

(75) Inventors: Peng Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 168 days.

(21) Appl. No.: 13/113,202

(22) Filed: May 23, 2011

(65) Prior Publication Data

US 2012/0161608 A1 Jun. 28, 2012

(30) Foreign Application Priority Data

Dec. 27, 2010 (CN) ..... 2010 1 0607382

(51) Int. Cl.
*H01J 9/06* (2006.01)

(52) U.S. Cl.
USPC ..... 313/346 R; 313/351; 977/939

(58) Field of Classification Search
USPC ..... 977/939; 313/309, 311, 336, 346 R, 313/351, 495–497
See application file for complete search history.

(56) References Cited

U.S. PATENT DOCUMENTS

| | | | | |
|---|---|---|---|---|
| 5,903,092 | A * | 5/1999 | Akama | 313/311 |
| 7,992,616 | B2 | 8/2011 | Liu et al. | |
| 2004/0095050 | A1* | 5/2004 | Liu et al. | 313/309 |
| 2006/0192475 | A1* | 8/2006 | Lee et al. | 313/495 |
| 2008/0018228 | A1* | 1/2008 | Choi et al. | 313/497 |
| 2008/0170982 | A1* | 7/2008 | Zhang et al. | 423/447.3 |

FOREIGN PATENT DOCUMENTS

| | | |
|---|---|---|
| CN | 1501422 A | 6/2004 |
| CN | 101407312 | 4/2009 |
| JP | 2004-165144 | 6/2004 |
| JP | 2006-114494 | 4/2006 |

* cited by examiner

*Primary Examiner* — Nimeshkumar Patel
*Assistant Examiner* — Steven Horikoshi
(74) *Attorney, Agent, or Firm* — Novak Druce Connolly Bove + Quigg LLP

(57) ABSTRACT

A field emission cathode structure includes a first carbon nanotube structure including a plurality of first carbon nanotubes, and a second carbon nanotube structure located on the surface of the first carbon nanotube structure. The second carbon nanotube structure includes a plurality of second carbon nanotubes substantially perpendicular to the first carbon nanotubes structure. The second carbon nanotube structure includes a peak. The heights of the second carbon nanotubes at the peak are tallest. The heights of the carbon second carbon nanotubes gradually decrease along the direction away from the peak. A method for fabricating the field emission cathode structure is also presented.

19 Claims, 12 Drawing Sheets

FIELD EMISSION CATHODE STRUCTURE

RELATED APPLICATIONS

This application claims all benefits accruing under 35 U.S.C. §119 from China Patent Application 201010607382.6, filed on Dec. 27, 2010 in the China Intellectual Property Office, the disclosure of which is incorporated herein by reference. This application is related to application Ser. No. 13/113,206 filed May 23, 2011 entitled, "COMPOSITE CARBON NANOTUBE STRUCTURE AND METHOD FOR FABRICATING THE SAME".

BACKGROUND

1. Technical Field

The present disclosure relates to a field emission cathode structure and a method for making the same.

2. Discussion of Related Art

Carbon nanotubes (CNTs) are electrically conductive along their length, chemically stable, and can have a very small diameter (much less than 100 nanometers) and large aspect ratios (length/diameter). Due to these and other properties, it has been suggested that CNTs can play an important role in many fields, such as in a field emission device.

At present, different methods are widely used for fabricating composite carbon nanotube structure. CNTs can be produced by means of arc discharge between graphite rods. Another method for fabricating a composite carbon nanotube structure has been disclosed in U.S. Patent Application No. 20060192475. However, this method is complex because the first CNTs should be separated from the first substrate by ultrasonic method, immersed into a solution, and then coated on the second substrate. Furthermore, while immersing the first CNTs into the solution, some catalysts on the surface of the first carbon nanotubes will drop off, such that only a few second CNTs can be obtained on the surface of the first carbon nanotubes. The first carbon nanotubes and the second carbon nanotubes form a structure, which can be used as a field emission cathode structure.

However, while this kind of field emission cathode structure is used to emit electrons, a shielding effect exists between two adjacent carbon nanotubes, because the carbon nanotubes of the second CNTs have the same length. Therefore, the electrons emission efficiency of the field cathode structure is relative low.

What is needed, therefore, is to provide a field cathode structure having relative high electron emission efficiency.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
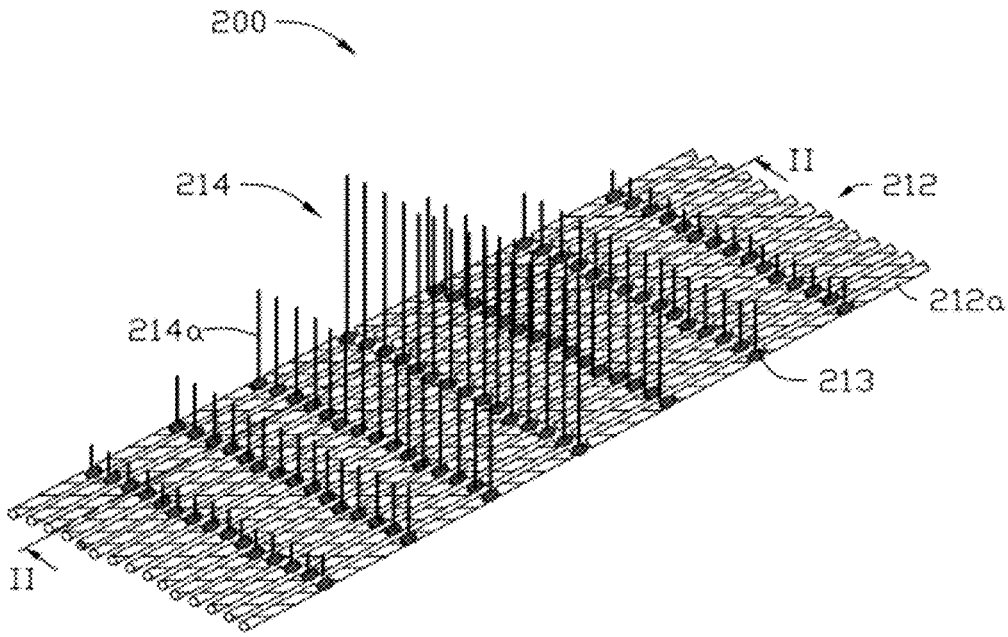
FIG. 1 is an isometric view of one embodiment of a field emission cathode structure.
Figure 2:
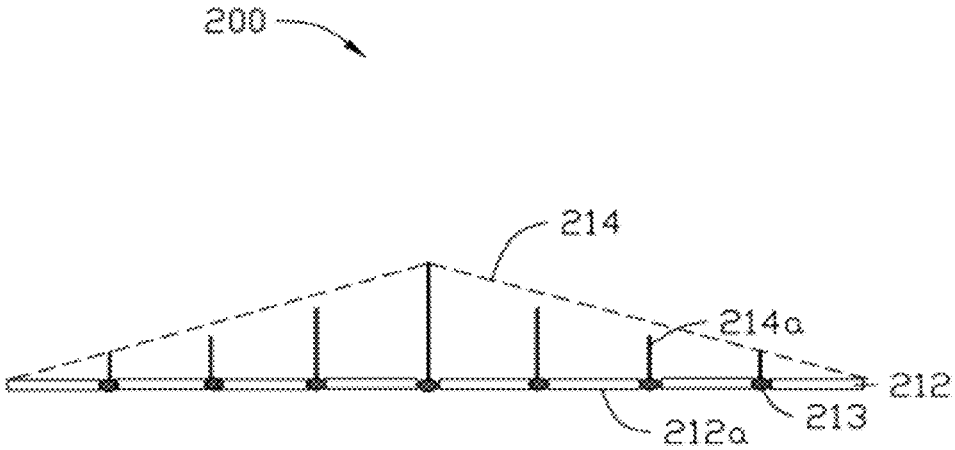
FIG. 2 is a cross-sectional view along a line II-II of FIG. 1.

Referring to FIG. 1 to FIG. 2, one embodiment of a field emission cathode structure 200 includes a first carbon nanotube structure 212 and a second carbon nanotube structure 214. The second carbon nanotube structure 214 is located on a surface of the first carbon nanotube structure 212 and is electrically connected with the first carbon nanotube structure 212.

The first carbon nanotube structure 212 includes a plurality of first carbon nanotubes 212*a* and a plurality of catalyst particles 213 dispersed therein. The axial direction of the first carbon nanotubes 212*a* is substantially parallel to the surface of the first carbon nanotube structure 212. The material of the catalyst particles 213 can be made of iron (Fe), cobalt (Co), nickel (Ni), or any alloy thereof. The catalyst particles 213 are located at the surface of the first carbon nanotube structure 212 or the junctions between two ends of adjacent first carbon nanotubes 212*a*.

The first carbon nanotubes 212*a* of the first carbon nanotube structure 212 can be disorderly or orderly aligned. In one embodiment, the first carbon nanotubes 212*a* are disorderly aligned and entangled with each other. In one embodiment, the first carbon nanotube structure 212 is isotropic. While the first carbon nanotubes 212*a* are orderly aligned, the first carbon nanotubes 212*a* are arranged in a consistently systematic manner, e.g., most of the carbon nanotubes are arranged substantially along the same aligned direction.

The first carbon nanotube structure 212 can be a freestanding structure. The term "free-standing structure" means that the first carbon nanotube structure 212 can sustain the weight of itself when it is hoisted by a portion thereof without any significant damage to its structural integrity. So, if the first carbon nanotube structure 212 is placed between two separate supports, a portion of the first carbon nanotube structure not in contact with the two supports would be suspended between the two supports and maintain structural integrity. The first carbon nanotube structure 212 includes a plurality of carbon nanotubes distributed uniformly and attracted by van der Waals attractive force therebetween.

The first carbon nanotube structure 212 can be a carbon nanotube film such as a drawn carbon nanotube film, a flocculated carbon nanotube film, a pressed carbon nanotube film, or a carbon nanotube film formed by spraying, coating, or deposition. In one embodiment, the first carbon nanotube structure 212 is a drawn carbon nanotube film.

Figure 3:
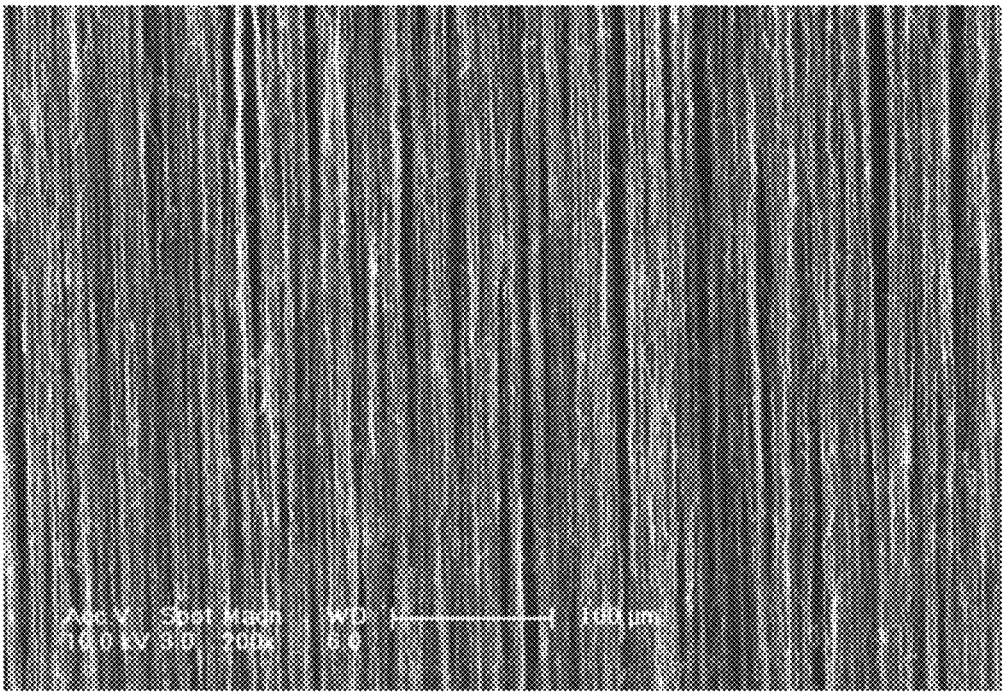
FIG. 3 shows a Scanning Electron Microscope (SEM) image of one embodiment of a first carbon nanotube structure of a field emission cathode structure.

Referring to FIG. 3, the drawn carbon nanotube film can be drawn from a carbon nanotube array. The drawn carbon nanotube film includes a plurality of carbon nanotubes arranged substantially parallel to a surface of the drawn carbon nanotube film. A large majority of the carbon nanotubes in the drawn carbon nanotube film can be oriented along a preferred orientation, meaning that a large majority of the carbon nanotubes in the drawn carbon nanotube film are arranged substantially along the same direction. An end of one carbon nanotube is joined to another end of an adjacent carbon nanotube arranged substantially along the same direction by van der Waals attractive force. The drawn carbon nanotube film is capable of forming a freestanding structure. The successive carbon nanotubes joined end to end by van der Waals attractive force realizes the freestanding structure of the drawn carbon nanotube film.

Some variations can occur in the orientation of the carbon nanotubes in the drawn carbon nanotube film. Microscopically, the carbon nanotubes oriented substantially along the same direction may not be perfectly aligned in a straight line, and some curve portions may exist. It can be understood that a contact between some carbon nanotubes located substantially side by side and oriented along the same direction cannot be totally excluded.

More specifically, the drawn carbon nanotube film can include a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity, and shape. The carbon nanotubes in the drawn carbon nanotube film are also substantially oriented along a preferred orientation. A thickness of the drawn carbon nanotube film can range from about 0.5 nanometers to about 100 micrometers. A width of the drawn carbon nanotube film relates to the carbon nanotube array from which the drawn carbon nanotube film is drawn.

In one embodiment, the first carbon nanotube structure 212 includes at least two drawn carbon nanotube films stacked with each other. An angle between the aligned directions of the carbon nanotubes in the two adjacent drawn carbon nanotube films can range from about 0 degrees to about 90 degrees)($0° \leq \alpha \leq 90°$. If $\alpha=0°$, the two adjacent drawn carbon nanotube films are arranged in the same direction with each other. The stacked drawn carbon nanotube films can improve the strength and maintain the shape of the first carbon nanotube structure 212.

The second carbon nanotube structure 214 includes a plurality of second carbon nanotubes 214*a*. The second carbon nanotubes 214*a* are substantially parallel to each other and substantially perpendicular to the surface of the first carbon nanotube structure 212. Each second carbon nanotube 214*a* extends from the surface of the first carbon nanotube structure 212. The second carbon nanotubes 214*a* have substantially the same interval along the aligned direction of the first carbon nanotubes 212*a* in the first carbon nanotube structure 212. In one embodiment, the second carbon nanotubes 214*a* are located on the catalyst particles 213 dispersed in the first carbon nanotube structure 212.

The second carbon nanotube structure 214 includes a plurality of rows of second carbon nanotubes 214*a* along an extending direction of the first carbon nanotubes 212*a*. The second carbon nanotubes 214*a* in each row have substantially the same uniform height. The distance between two adjacent two rows is substantially the same, and the distance between the adjacent second carbon nanotubes 214*a* in each row is substantially the same. The second carbon nanotubes 214*a* in a middle row have a height greater than that of the second carbon nanotubes 214*a* in other rows. The height of the second carbon nanotubes 214*a* in different rows gradually decreases from the middle row toward two opposite directions of the middle row such that the second carbon nanotubes 214*a* form a triangular cross-section structure. The second carbon nanotube structure 214 is configured so the shielding effect of the two adjacent second carbon nanotubes 214*a* in different adjacent rows will be reduced. The electron emission ability of the second carbon nanotubes 214*a* at the edge of the second carbon nanotube structure 214 will be reduced. The electron emission ability of the second carbon nanotubes 214*a* at the top of the second carbon nanotube structure 214 will be enhanced. Therefore, uniformity of the field emission density of the second carbon nanotube structure 214 will be improved.

The second carbon nanotubes 214*a* can be regularly distributed on the surface of the first carbon nanotube structure 212. In one embodiment, the catalyst particles 213 are located at junctions of the two adjacent carbon nanotubes of the first carbon nanotube structure 212. The second carbon nanotubes 214*a* are grown from the catalyst particles 213. Each second carbon nanotube 214*a* extends from the catalyst particles 213. The catalyst particles 213 are substantially dispersed at a certain distance along the drawn direction of the drawn film, and the distance is equal to the length of each of the first carbon nanotubes 212*a*. The second carbon nanotubes 214*a* are spaced from each other a distance equal to the length of the first carbon nanotubes 212*a* along the aligned direction. Thus, the shielding effect will be reduced and the uniformity of the field emission density will be improved.

Furthermore, the field emission cathode device 200 can include a substrate 220. The first carbon nanotube structure 212 and the second carbon nanotube structure 214 are located on a surface of the substrate 220. The first carbon nanotube structure 212 can be attached to the surface of the substrate 220 or suspended above the surface of the substrate 220.

Figure 4:
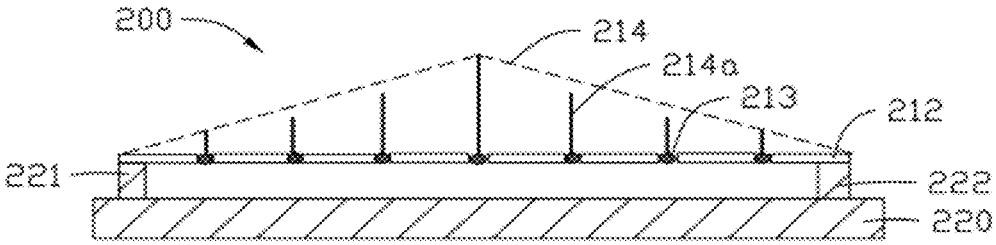
FIG. 4 is a view of one embodiment of a field emission cathode structure suspended above a substrate.

Referring to FIG. 4, in one embodiment, the first carbon nanotube structure 212 is suspended above the surface of the substrate 220. The field emission cathode device 200 can further include two supports located on the surface of substrate 220 and spaced from each other. In one embodiment, a first conductive base 221 and a second conductive base 222 are used as two supports. The material of the supports can be metals, metal alloys or conductive composite materials. The shape of the supports is arbitrary as long as each support has a planar surface to support one end of the first carbon nanotube structure 212. In one embodiment, the shape of each of the first conductive base 221 and the second conductive base 222 is cuboid. The interval of the first conductive base 221 and the second conductive base 222 can be chosen according to need.

The present field emission cathode structure 200 has the following advantages. First, because the first carbon nanotube structure 212 is a freestanding structure, the field emission cathode structure 200 can be conveniently used in a field emission device. Second, because the second carbon nanotube structure 214 can have a triangular structure, the electron emission ability at the edge of the second carbon nanotube structure 214 will be reduced, and the uniformity of the field emission density of second carbon nanotube structure 214 will be improved. Third, the field emission cathode structure 200 can be used as a thermal field emission device if a current is applied to the first carbon nanotube structure 212 to heat the second carbon nanotube structure 214. Thus, the impurities on the surface of the second carbon nanotube structure 214 will be avoided by heating and the stability of the field emission will be improved. Furthermore, because the first carbon nanotube structure 212 has a high heat capacity per unit area, the field emission cathode structure 200 has a small heating power consumption and very fast response speed.

Figure 5:
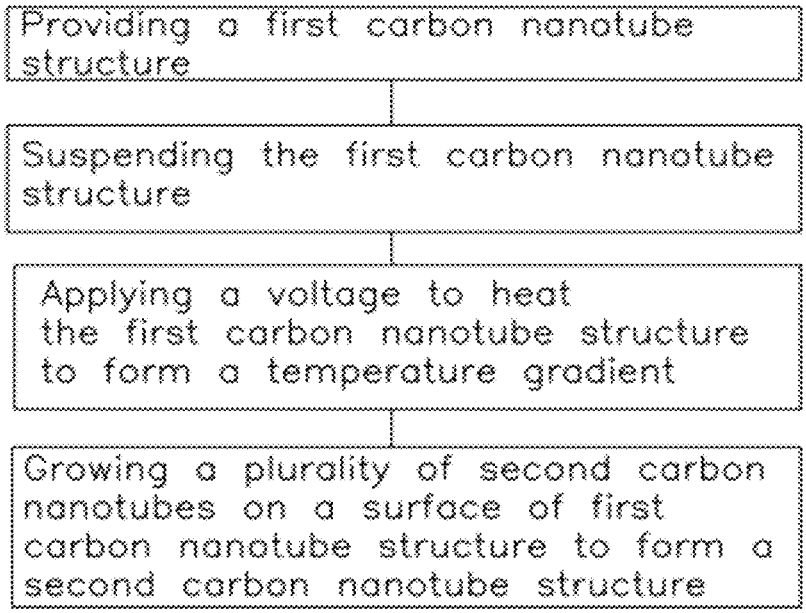
FIG. 5 is a flow chart of one embodiment for making a field emission cathode structure.
Figure 6:
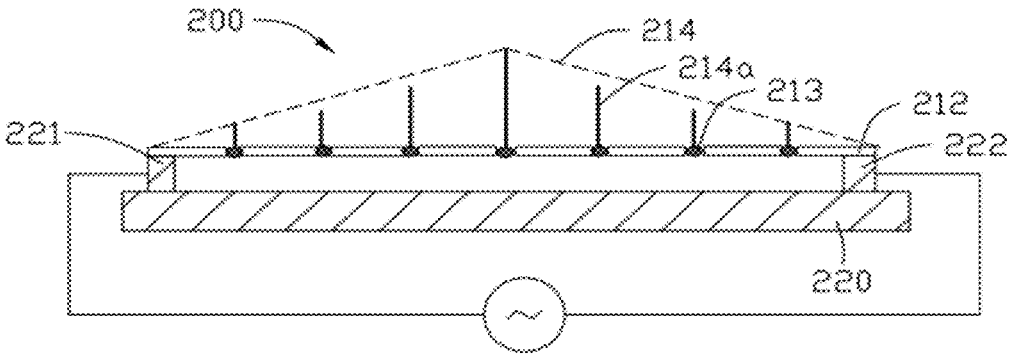
FIG. 6 is a view of one embodiment of a fabrication device for making a field emission cathode structure.

Referring to FIG. 5 and FIG. 6, a method for fabricating the field emission cathode structure 200 is also provided. The method includes the following steps:

(S21) providing a first carbon nanotube structure 212;

(S22) suspending the first carbon nanotube structure 212;

(S23) applying a voltage to heat the first carbon nanotube structure 212 to form a temperature gradient; and (S24) growing a plurality of second carbon nanotubes 214*a* on the surface of the first carbon nanotube structure 212 to form a second carbon nanotube structure 214.

In step (S21), the first carbon nanotube structure 212 can be a drawn carbon nanotube film fabricated by the following steps:

(S211) providing a substrate and growing an array of carbon nanotubes on the substrate, and in one embodiment, the array of carbon nanotubes is a super-aligned array of carbon nanotubes;

(S212) drawing out a plurality of carbon nanotube segments having a predetermined width from the super-aligned carbon nanotube array at an even/uniform speed to achieve a uniform carbon nanotube film by using a tool allowing multiple carbon nanotubes to be gripped and pulled simultaneously, such as adhesive tape.

During the process of drawing the carbon nanotube film from the carbon nanotube array, a plurality of the catalyst particles 213 will be attached to one end of each carbon nanotube and separated from the substrate. Therefore, the catalyst particles 213 will be dispersed in the carbon nanotube film. The catalyst particles 213 are located on the junction between two ends of adjacent carbon nanotubes joined end to end by van der Waals force. Because the carbon nanotubes have substantially the same length, the carbon nanotube segment has the same length, and the catalyst particles 213 are uniformly dispersed in the carbon nanotube film. The term "uniformly" means that the catalyst particles 213 are dispersed in the carbon nanotube film with substantially the same interval along the drawing direction.

Furthermore, if the catalyst particles 213 remaining on the first carbon nanotube structure 212 are insufficient, the method can include a step of depositing a plurality of second catalyst particles (not shown) on the surface of the first carbon nanotube structure 212. The second catalyst particles can be uniformly deposited by electron beam evaporation, sputtering, plasma beam deposition, electro-deposition, and coating.

Furthermore, the first carbon nanotube structure 212 can be formed by stacking at least two drawn carbon nanotube films with each other.

In step (S22), the step of suspending the first carbon nanotube structure 212 includes following steps:

(S221) providing a substrate 220 having a surface;

(S222) providing a first conductive base 221 and a second base 222, and locating the first conductive base 221 and the second base 222 on the surface of substrate 220 at a certain interval; and (S223) attaching the first carbon nanotube structure 212 on the first conductive base 221 and the second base 222 to suspend the first carbon nanotube structure 212 above the substrate 220.

In step (S221), the substrate 220 can be a silicon wafer or a silicon wafer with a film of silicon dioxide thereon. The shape of the substrate 220 can be selected according to need. In one embodiment, the shape of the substrate 220 is rectangular.

In step (S222), the interval between the first conductive base 221 and the second conductive base 222 can be in a range from about 2 millimeters to about 2 centimeters. In one embodiment, the interval of the first conductive base 221 and the second conductive base 222 is about 1 centimeter.

In step (S223), one end of the first carbon nanotube structure 212 is fixed on the first conductive base 221 and the opposite end is fixed on the second conductive base 222. The first carbon nanotube 212*a* extends from the first conductive base 221 to the second conductive base 222. The first carbon nanotube structure 212 between the first conductive base 221 and the second conductive base 222 is suspended above the substrate 220.

In step (S23), the second carbon nanotubes 214*a* can be grown on the first carbon nanotube structure 212 by CVD method. The CVD method includes the following steps:

step (S231), locating the substrate 220 into a furnace and introducing a carbon containing gas and a protecting gas in the furnace;

step (S232), applying a voltage to the first carbon nanotube structure 212 via the first conductive base 221 and the second conductive base 222 to heat the first carbon nanotube structure 212 to a growing temperature of the second carbon nanotubes 214*a*.

In step (S231), the carbon containing gas can be a hydrocarbon gas, such as acetylene or ethane. The protecting gas can be $N_2$, $Ar_2$, or another inert gas.

In step (S232), the first carbon nanotube structure 212 can transfer electric energy to heat effectively. The voltage can be selected according to the length of the first carbon nanotube structure 212 and the diameter of the first carbon nanotubes 212*a*. In one embodiment, the diameter of the first carbon nanotubes 212*a* is about 5 nanometers, and the voltage is about 40 V. A direct current is introduced to the first carbon nanotube structure 212 via the two supports. The direct current flows from one support to another support. The first carbon nanotube structure 212 is heated to a temperature in a range from about 500° C. to about 900° C. The second carbon nanotubes 214*a* are grown for about 1 minutes to about 60 minutes.

During the process of heating the first carbon nanotube structure 212, the temperature of the first carbon nanotube structure 212 increases due to Joule-heating. The heat produced by the first carbon nanotube structure 212 can be conducted to the first conductive base 221 and the second conductive base 222, and the heat can also be transferred to the surroundings by radiation at the same time. Because the first conductive base 221 and the second conductive base 222 is used as a heat sink, the heat which is near the first conductive base 221 or the second conductive 222 can be transferred to the surroundings rapidly. But at the middle position of the first carbon nanotube structure 212 between the first conductive base 221 and the second conductive base 222, the heat cannot be conducted out rapidly, so the temperature at this position is higher than at other positions. The temperature of the first carbon nanotube structure 212 decreases gradually along the direction away from the middle position to both the first conductive base 221 and the second conductive base 222 thereby forming a temperature gradient.

After applying the voltage on the first carbon nanotube structure 212 a predetermined time, a plurality of the second carbon nanotubes 214*a* grow on the first carbon nanotube structure 212. The second carbon nanotubes 214*a* form the second carbon nanotube structure 214. Because a maximum temperature occurs at the middle position of the first carbon nanotube structure 212, the second carbon nanotubes 214*a* at this position grows faster than at other position. Therefore, the second carbon nanotubes 214*a* have a triangular configuration having a peak. The second carbon nanotubes 214*a* at the peak are the tallest. The height of the carbon nanotubes 214*a* gradually decreases from the peak to both the first conductive base 221 and the second conductive base 222.

Furthermore, during the process of applying a voltage to the first carbon nanotube structure 212, a heating device (not shown) can be used to heat the furnace to increase the growing speed of the second carbon nanotubes 214*a*. The heating temperature should be low enough so that the temperature gradient can be maintained.

Figure 7:
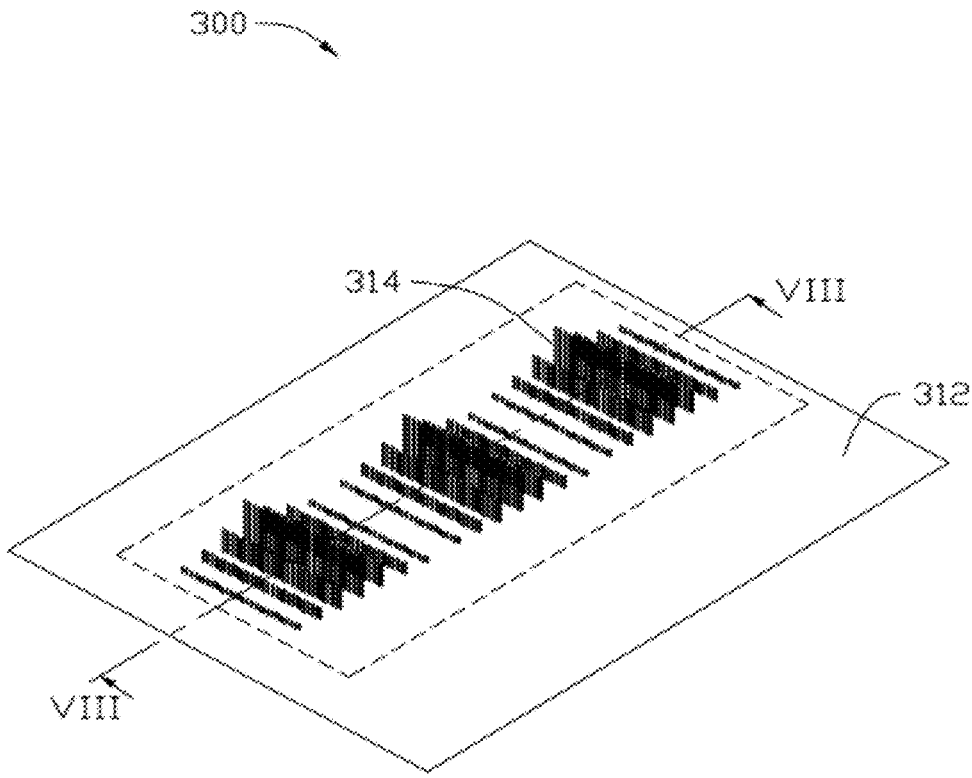
FIG. 7 is an isometric view of one embodiment of a field emission cathode structure.
Figure 8:
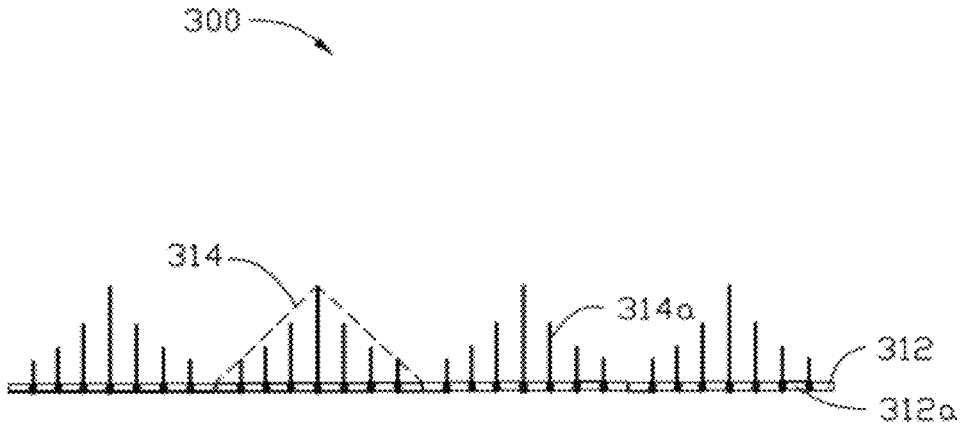
FIG. 8 is a cross-sectional view along a line—of FIG. 7.

Referring to FIG. 7 and FIG. 8, one embodiment of a field emission cathode structure 300 includes a first carbon nanotube structure 312 and a plurality of second carbon nanotube structures 314. The field emission cathode structure 300 is similar to the field emission cathode structure 200, except that the number of the second carbon nanotube structures 312 is more than that of the second carbon nanotube structure 212.

Figure 9A:
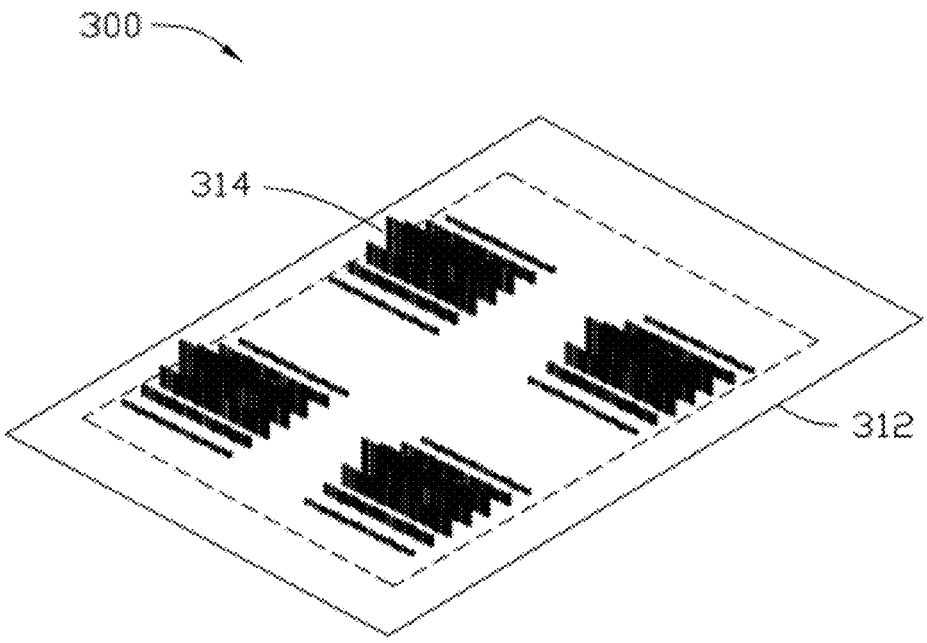
FIG. 9A is an isometric view of one embodiment of a field emission cathode structure comprising a plurality of peaks.
Figure 9B:
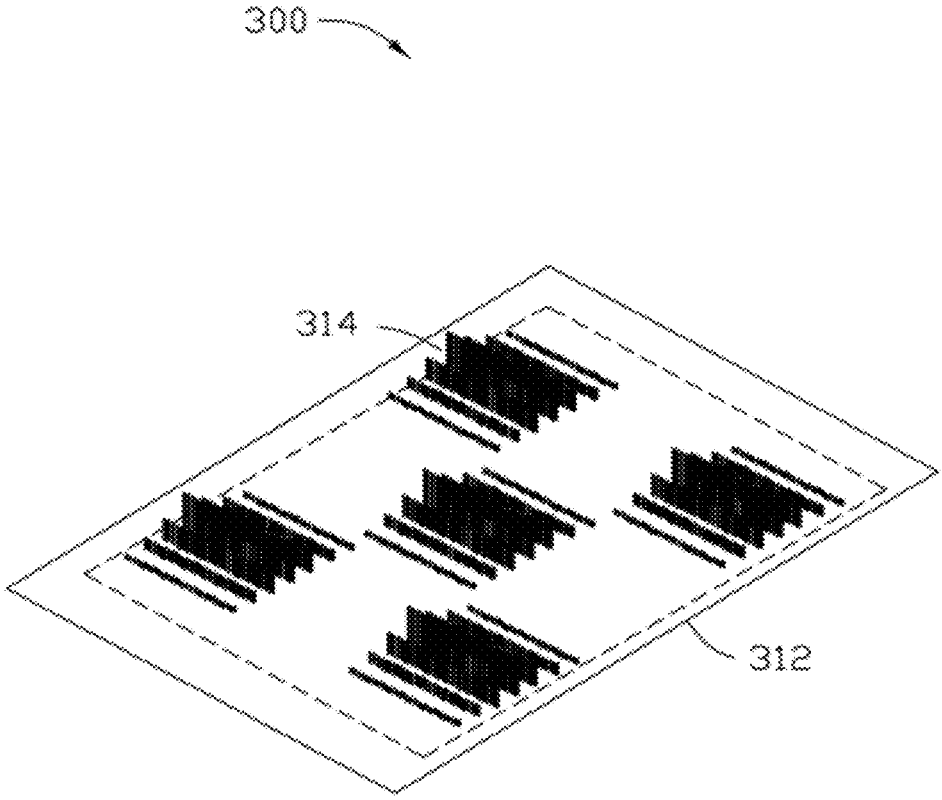
FIG. 9B is an isometric view of another embodiment of a field emission cathode structure comprising a plurality of peaks.

Each of the second carbon nanotube structures 314 includes a peak where the heights of the second carbon nanotubes 314*a* are the tallest. Each of the second carbon nanotube structures 314 has a triangular cross section structure. The plurality of the second carbon nanotube structures 314 can be located in series or spaced from each other. The plurality of the second carbon nanotube structures 314 can be aligned in a substantially straight line. Referring to FIG. 9A and FIG. 9B, the plurality of the second carbon nanotube structures 314 can also be aligned to form a pattern or array according to need.

The field emission cathode structure 300 can further include a substrate 320. The first carbon nanotube structure 312 is located on a surface of the substrate 320, and a number of second carbon nanotube structures 314 are located on a surface of the first carbon nanotube 312. The second carbon nanotubes 314*a* extends from the surface of the first carbon nanotube structure 312. In one embodiment, the first carbon nanotube structure 312 can be directly attached on the substrate 320.

Figure 10:
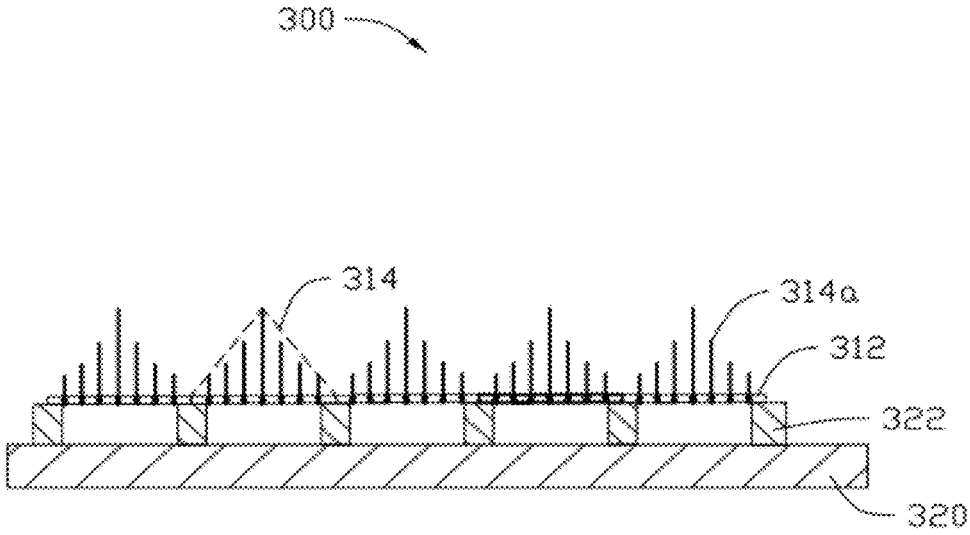
FIG. 10 is a view of one embodiment of field emission cathode structure suspending on a substrate.

Referring to FIG. 10, while the first carbon nanotube structure 312 is suspended on the substrate 320, the field emission cathode device 300 can further include a number of supports spaced from each other. In one embodiment, the support can be a conductive base 322. The interval between the adjacent conductive bases 322 can be selected according to need.

Figure 11:
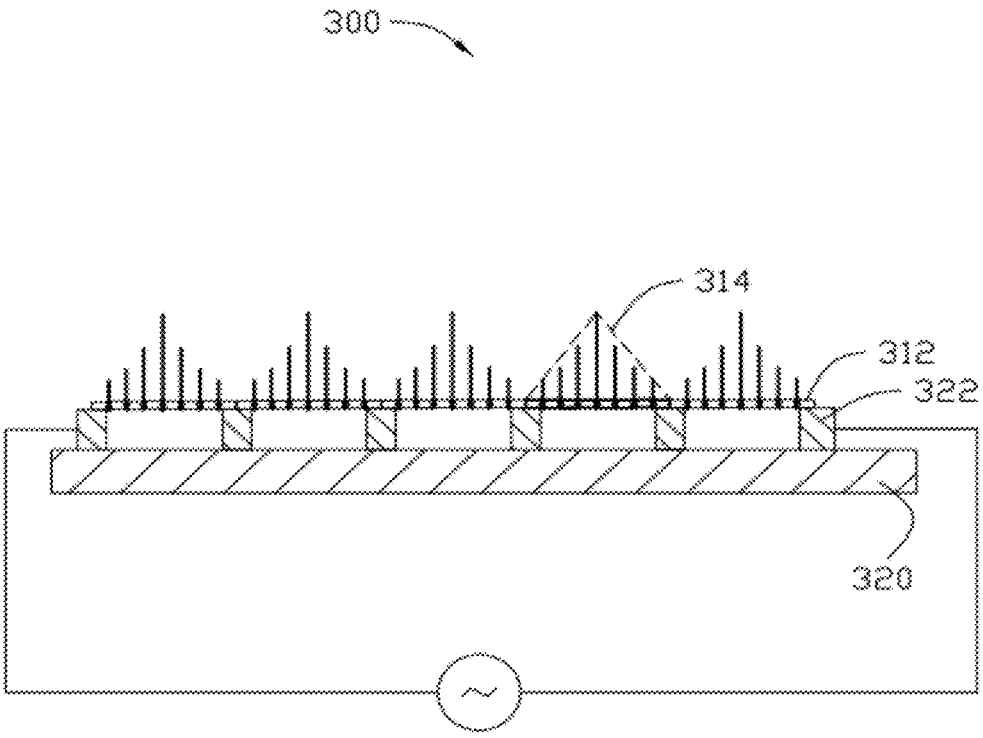
FIG. 11 is a view of one embodiment of a fabrication device for making a filed emission cathode structure.

Referring to FIG. 11, a method of fabricating the field emission cathode structure 300 includes:

(S31) providing a first carbon nanotube structure 312;

(S32) suspending the first carbon nanotube structure 312;

(S33) applying a voltage to heat the first carbon nanotube structure 312 to form a temperature gradient; and (S32) growing a number of second carbon nanotube structures 314 on the surface of first carbon nanotube structure 312, wherein each second carbon nanotube structure 314 has a peak.

The method of fabricating the field emission cathode structure 300 is similar to that of fabricating the field emission cathode structure 200, except that in the step (S32), a plurality of the conductive bases 322 are located on the substrate 320 at intervals. The first carbon nanotube structure 312 is suspended on the substrate 320. A part of the first carbon nanotube structure 312 between the adjacent conductive bases 322 is spaced from the substrate 320.

In the step (S33), when a voltage is applied on the two adjacent conductive bases 322, the temperature of the middle position of every two adjacent conductive bases 322 is higher than other positions. The second carbon nanotubes 314*a* grow rapidly at the middle position of every two adjacent conductive bases 322, and then a second carbon nanotube structure 314 is formed between every two adjacent conductive bases 322. The second carbon structure 314 has a peak, and the second carbon nanotube 314*a* at the peak is the tallest. Furthermore, the voltage can be applied to any two adjacent conductive bases 322 to grow a number of second carbon nanotube structures 314 on the first carbon nanotube structure 312. The plurality of the second carbon nanotube structures 314 formed to a pattern such as a triangular pattern or rectangular pattern.

In the method of fabricating the field emission cathode structure, the drawn carbon nanotube film is used as a growing substrate to grow carbon nanotubes. The method is suitable to industrial production. Because the catalyst particles in the drawn carbon nanotube film are uniformly dispersed, the carbon nanotubes located on the catalyst particles can be dispersed so the electron shield effect will be reduced. Furthermore, the drawn carbon nanotube film can be heated by introducing a current, and other heating devices can be avoided, simplifying the process.

Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

The invention claimed is:

1. A field emission cathode structure comprising:

a first carbon nanotube structure comprising a plurality of first carbon nanotubes, wherein the plurality of first carbon nanotubes are joined end to end along an alignment direction;

a second carbon nanotube structure located on a surface of the first carbon nanotube structure, the second carbon nanotube structure comprising a plurality of second carbon nanotubes substantially perpendicular to the first carbon nanotube structure;

wherein the second carbon nanotube structure comprises a peak, and heights of the plurality of second carbon nanotubes gradually decrease along a direction away from the peak.

2. The field emission cathode structure of claim 1, wherein the first carbon nanotube structure is a free-standing structure.

3. The field emission cathode structure of claim 1, wherein the plurality of first carbon nanotubes are substantially parallel to a surface of the first carbon nanotube structure.

4. The field emission cathode structure of claim 3, wherein the plurality of first carbon nanotubes are joined end to end by van der Waals attractive force.

5. The field emission cathode structure of claim 1, wherein the first carbon nanotube structure comprises a plurality of catalyst particles dispersed at junctions of adjacent two of the first carbon nanotubes.

6. The field emission cathode structure of claim 5, wherein the plurality of catalyst particles are dispersed at a substantially same distance along the alignment direction of the plurality of first carbon nanotubes.

7. The field emission cathode structure of claim 5, wherein the plurality of second carbon nanotubes is connected to the first carbon nanotubes via the plurality of catalyst particles.

8. The field emission cathode structure of claim 1, further comprising a substrate, and the first carbon nanotube structure is directly attached on the substrate.

9. The field emission cathode structure of claim 1, further comprising a substrate, and the first carbon nanotube structure is suspended above the substrate.

10. The field emission cathode structure of claim 1, wherein one end of each of the plurality of second carbon nanotubes is connected to the surface of the first carbon nanotube structure and another end of each of the second nanotubes extends away from the first carbon nanotube structure.

11. The field emission cathode structure of claim 1, wherein the plurality of second carbon nanotubes are formed in rows aligned with an extending direction of the first carbon nanotubes.

12. The field emission cathode structure of claim 11, wherein the plurality of second carbon nanotubes in each of the rows are aligned along a direction perpendicular to the extending direction of the first carbon nanotubes and have a substantially uniform height, and heights of the second carbon nanotubes being the tallest in a middle row of the rows, and heights of the second carbon nanotubes gradually decrease from the middle row toward opposite directions of the middle row.

13. The field emission cathode structure of claim 11, wherein a distance between adjacent two of the rows is substantially the same.

14. The field emission cathode structure of claim 1, a cross-section of the second carbon nanotube structures is triangular.

15. A field emission cathode structure comprising:

a first carbon nanotube structure comprising a plurality of first carbon nanotubes, wherein the first carbon nanotube structure is a free-standing structure;

a second carbon nanotube structure located on a surface of the first carbon nanotube structure, the second carbon nanotube structure comprising a plurality of second carbon nanotubes, substantially perpendicular to the first carbon nanotubes structure and forming an array;

wherein the plurality of second carbon nanotubes are arranged in a plurality of rows, and the plurality of rows are aligned substantially along an alignment direction of the first carbon nanotubes, heights of the second carbon nanotubes are gradually decrease away from the middle row, and the heights of the second carbon nanotubes in the middle row being the highest.

16. A field emission cathode structure comprising:

a first carbon nanotube structure comprising a plurality of first carbon nanotubes arranged substantially along an alignment direction and joined end to end;

a plurality of second carbon nanotube structures located on a surface of the first carbon nanotube structure, and each of the plurality of carbon nanotube structures comprises a plurality of carbon nanotubes;

wherein each of the plurality of second carbon nanotube structures comprises a peak, and a height of the carbon nanotubes in the peak is the tallest, and a cross-section of each of the plurality of second carbon nanotube structures is triangular.

17. The field emission cathode structure of claim 16, wherein the plurality of second carbon nanotube structures are substantially aligned along the alignment direction of the plurality of first carbon nanotubes.

18. The field emission cathode structure of claim 16, wherein the plurality of second carbon nanotube structures are spaced from each other to form an array.

19. The field emission cathode structure of claim 16, wherein heights of the plurality of carbon nanotubes in each of the plurality of second carbon nanotube structures gradually decreases away from a middle of each of the plurality of second carbon nanotube structures.

* * * * *